United States Patent [19]

Osterberg et al.

[11] 4,154,648

[45] May 15, 1979

[54] METHOD FOR SEPARATING A PAPER WEB FROM A FORMING FABRIC IN A PAPER-MAKING MACHINE

[75] Inventors: Lars B. Osterberg, Halmstad; Bengt A. Unneberg, Karlstad, both of Sweden

[73] Assignee: Nordiska Maskinfilt Aktiebolaget, Halmstad, Sweden

[21] Appl. No.: 843,814

[22] Filed: Oct. 20, 1977

Related U.S. Application Data

[63] Continuation-in-part of Ser. No. 555,409, Mar. 5, 1975, abandoned.

[30] Foreign Application Priority Data

Mar. 8, 1974 [SE] Sweden ..... 31204/74

[51] Int. Cl.[2] ..... D21F 11/00

[52] U.S. Cl. ..... 162/195; 162/199; 162/275; 162/286; 162/307

[58] Field of Search ..... 162/191, 195, 199, 264, 162/275, 286, 297, 306, 307, 310, DIG. 7

[56] References Cited

U.S. PATENT DOCUMENTS

| | | | |
|---|---|---|---|
| 1,864,726 | 6/1932 | Griffin | 162/195 |
| 2,215,335 | 9/1940 | Parkhill et al. | 162/195 X |
| 2,990,013 | 6/1961 | Rance et al. | 162/307 |
| 3,218,227 | 11/1965 | Moore et al. | 162/275 X |
| 3,245,872 | 4/1966 | Nelson | 162/264 X |

*Primary Examiner*—Richard V. Fisher

[57] ABSTRACT

A method for the separation of the paper web from the forming fabric in a paper-making machine comprising dividing the web into lengthwise strips to lessen the web adherence to the wire by utilization of a spray means incorporating a plurality of nozzles and then effecting web knock-down and separation from the wire by use of a slotted spray through which pressurized air jets are directed.

Through this method very low pressures are required to achieve web separation and the risks of re-contact between web and wire are positively prevented.

9 Claims, 6 Drawing Figures

METHOD FOR SEPARATING A PAPER WEB FROM A FORMING FABRIC IN A PAPER-MAKING MACHINE

CROSS REFERENCE TO RELATED APPLICATION

This application is a Continuation-in-Part of U.S. Application Ser. No. 555,409, filed Mar. 5, 1975, now abandoned.

BACKGROUND OF THE INVENTION

In the start up of paper-making machines and in the event of web ruptures therein, the paper web can be removed at several different points along the paper-making machine. If the sheet being formed in the forming section cannot immediately be transferred to the press section of the machine, the separation of the sheet from the forming wire must as a rule take place after the couch or head roll of the machine with the sheet being knocked down into a couch pit provided for this purpose. In general, water jets are used to knock down the sheet. Fresh water is usually used for this which also requires a corresponding amount of discharge of fibre-containing waste water from the circulation system of the paper-making machine. The jets that knock down and separate the sheet from the wire normally require high pressures in the range of 10 to 15 kp/cm$^2$ and the required water quantity is about 200 to 500 liters/minute for each meter of paper machine width. Considering environment preservation aspects it is therefore desirable that new alternatives to the depression jets be found. In certain paper-making machines attempts have been made to solve the problem by using internal cleansing of the waste water to be used for the water jets on the web. In some cases purified waste water is used also for the depression jets. However, this is not an altogether satisfactory solution as complete cleansing cannot be achieved and because there are risks of clogging of the spray nozzles which as a rule consist of circular openings having a diameter of 1 to 2 millimeters, and also risks for fibre formation on the inner face of the wire and on the leading rolls in the return part of the wire.

It has also been found that water jets used to depress the fibre web decrease in efficiency as the speed of the wire in the paper-making machine is increased. Metal wires have to a large extent been replaced on modern machines by synthetic forming fabrics. When plastic forming fabrics are used it is considerably more difficult to separate the web from forming fabric as compared with the use of metal wires, particularly at high machine speeds. Additionaly, when the web is separated from the wire it is often dragged along with the wire beyond the wire pit or towards the leading rolls in the wire return part. Attempts have been made to solve this problem by increasing the pressure and the quantity of water in the knock down spray pipes with little success.

In the removal of a paper web from the forming wire a distinction is made between the two following, separate operational steps, viz.:

1. Removal of a paper web and transfer thereof onto a felt. This step may be performed in machines similar to the one described in the U.S. Pat. No. 2,990,013.

2. Knock-off of the paper web into a couch pit provided for this purpose. Such knock-off takes place in connection with web breaks and when the paper web is allowed to accompany the wire somewhat further but is to be removed before the wire passes the first return roll. Applicants' invention is directed to this latter operation.

In addition, various spray apparatuses and methods are used in the industry to clean the wire and for edge-cutting purposes. Modern development of paper machines and forming wires has made it more difficult to knock off the paper web. The increases in machine speed and use of synthetic forming wires have complicated things considerably. To counter-act the weaker dimensional stability of the synthetic resin (plastics) wires the so-called double-layer synthetic wires are frequently used. These however present the disadvantage of making knock-off of the paper web more difficult.

It is common to provide one or several shower tubes of high-pressure type for knock-off. These showers include nozzles which are positioned at a fixed distance from one another. In old machines and machines of reduced dimensions the knock-off shower operates continuously and under normal operational conditions serves as a cleaning shower. Large, up-to-date machines usually comprise sensor means of some kind to detect web breaks, which sensors either start the function of the showers or increase the shower pressure from low-pressure spraying to high-pressure spraying. The structure in accordance with the U.S. Pat. No. 3,218,227 is in principle of an ordinary basic design equipped with a special means to rapidly start up the showers when wire breaks occur.

As mentioned earlier, the U.S. Pat. No. 2,990,013 describes a system for removal of the paper web from the wire and transfer thereof onto a felt. The system is based on a two-channel system comprising a suction slot the purpuse of which is to form a film of water between the web and the wire, and a slot emitting a jet of compressed air to lift the sheet from the wire. For the purpose of removing the paper web and transferring it to a felt the air-jet slot is the one most commonly used. It is true that an air-jet spray may detach the web from the wire but the web is moved into renewed contact with the web by the air currents caused by the forward movement of the wire.

SUMMARY OF THE INVENTION

In order to prevent the web from being sucked into renewed contact with the wire, the present invention teaches as a method the division of the web into narrow strips with the aid of a water or air jet spray in the form of a number equidistantly spaced nozzles arranged in a row in a direction across the wire followed by knocking-down of the strips with the aid of an air spray, whereby the web is forced away from the wire. Through the flapping movements imparted to the strips the following condition is broken and re-suction against the wire is prevented.

The present invention has as its object to provide a method of web separation which will remedy the difficulties presently encountered and especially in high speed machines. The invention is based on the realization that the best way to achieve reliable web separation is to use air spray means since it is believed that the wetting effected by water spray negatively affects the knock down effect in that the adhesion is caused thereby to increase between the wet paper web and the forming wire.

The air spray means is formed with a narrow slot—having a width of about 0.5 to 2 millimeters—extending over the entire width of the wire and abutting against the wire. For separation (knock down) of the fibre web (sheet) from the wire a comparatively low pressure is as a rule required, i.e. in the range of 0.1 to 0.4 kp/cm$^2$. In rapid paper-making machines higher pressures are, however, required, appr. 0.5 to 2 kp/cm$^2$ in order to achieve separation of the web from the wire. The reason is that the fibre web is entrained by the air flow existing around the wire and in some cases the web may also, following a brief separation, be brought into renewed contact with the wire and again adhere to the latter. Any further pressure increase in the air spray consequently serves only to remove the sheet from the boundary layer to which the sheet, on account of the air flow, is again attracted. On the other hand, if the web is first divided into narrow strips in accordance with the teachings of the present invention—the strip width preferably being between 50 to 500 millimeters—followed by knocking-down of the strips as likewise taught by the present invention the web is efficiently removed from the wire without it being necessary to let the air pressure exceed the pressure at which the web begins to separate from the wire, i.e. in the range of 0.1 to 0.4 kp/cm$^2$.

The division of the web into strips is effected with the aid of a water or air spray in the form of a row of nozzles positioned close to the inner or outer face of the wire. For environmental reasons air is preferably used also for this spray. The explanation of the effects obtained as a result of the division of the sheet into strips is on the one hand that the passage of the air originating from subsequent spray pipes through the wire and the web is facilitated and on the other that the flapping movements of the strips disturbs the flow conditions of the air layer closest to the wire with the result that the fibre web no longer is attracted to the wire and dragged along therewith. Depression of the fibre web may also be facilitated by interrupting the air flow along the wire by means of stationary screens or air curtains provided on the external face of the wire. The showers are known per se and used for various purposes in paper machines other than as disclosed in the method herein, but the improvements which are obtained through the present method of dividing the web into narrow strips and the subsequent knock-off provides a new result which is not obvious and utilizes the components to perform new functions.

BRIEF DESCRIPTION OF THE DRAWINGS

The invention will be described more in detail in the following with reference to the accompanying, partly diagrammatical drawings, wherein.

DETAILED DESCRIPTION OF A PREFERRED EMBODIMENT

Figure 1:
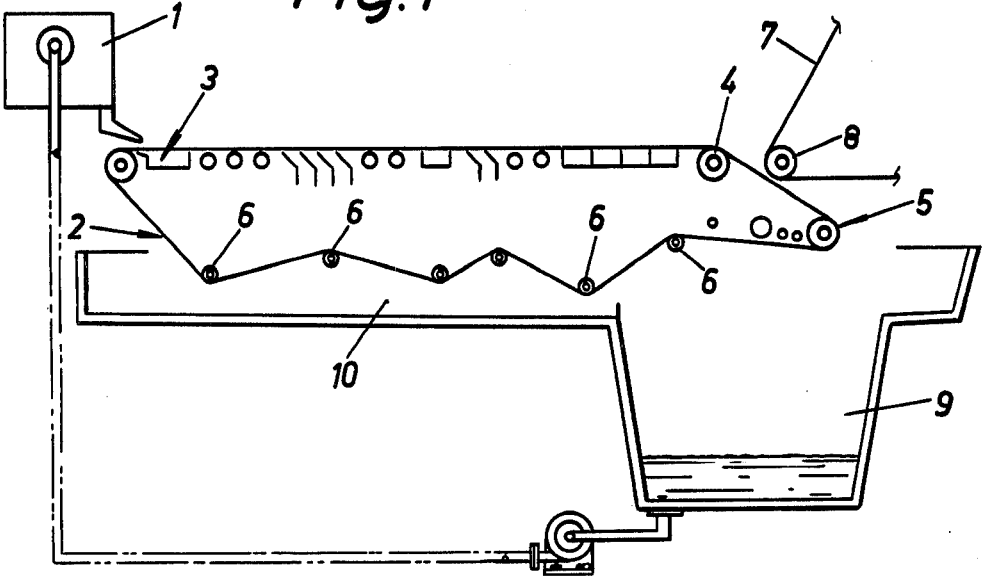
FIG. 1 is a forming section of a paper-making machine during normal operating conditions.

The pulp from the headbox 1 of a paper-making machine is spread over a continuous forming fabric 2. A portion of the fabric runs on top of a table 3 on which the sheet formation takes place. The fabric 2 is then supported by table rolls and suction boxes which also serve as dewatering means for the paper sheet. When the fabric has passed over the couch roll 4 and the head roll 5 of the machine it returns via a number of leading and tensioning rolls 6.

Figure 2:
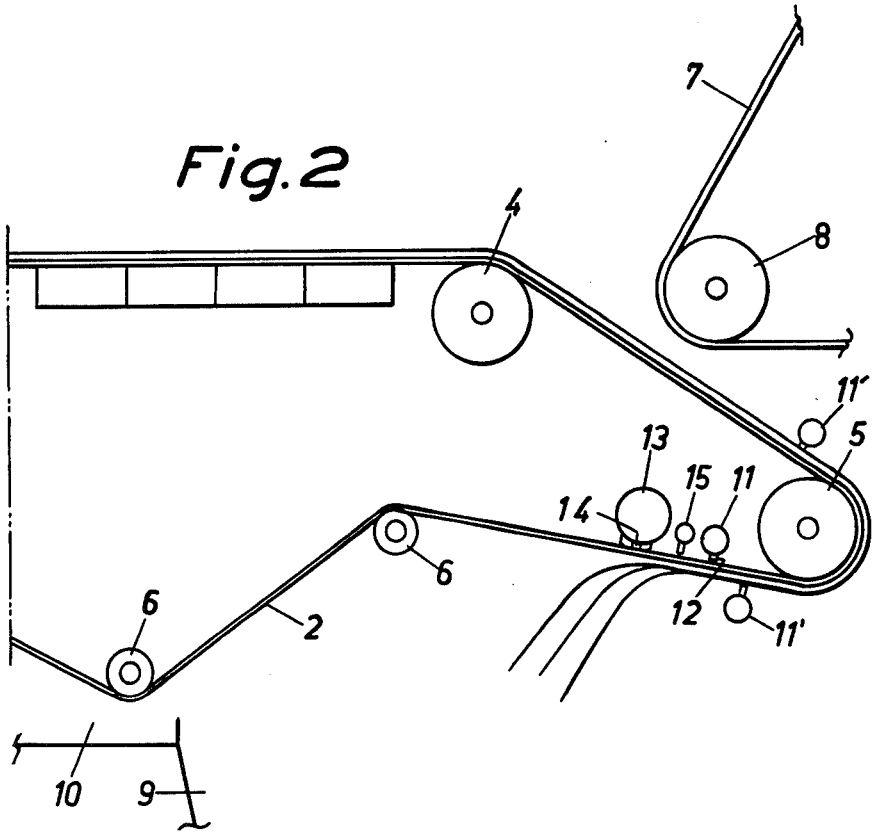
FIG. 2 illustrated on an enlarged scale the terminal end of the forming section during starting-up, e.g. when the paper web, having been depressed, is to run down into a couch pit.

During production, the paper sheet a is removed from the forming fabric 2 by a pick-up felt 7 running over the pick-up roll 8. When the machine is started up or other breaks in production occur, the pick-up roll 8 (See FIG. 2), is lifted and the sheet a then accompanies the fabric 2 around the head roll 5. The sheet a must then be struck so as to separate from the fabric 2 and fall down into the couch pit 9. If this striking operation is not performed with efficiency, the paper sheet continues to accompany the fabric up to the return leading rolls 6. This risks fibre formation occuring on these leading rolls, which can ultimately result in fabric fracture. In addition, the paper pulp will fall into the wire pit 10 of the machine and pollute the water system which supplies water to the cleaning spray means of the wire. When the forming takes place on metal wires and the machine speed is low, satisfactory separating results are often obtained while using ordinary water spray means, preferably positioned after the head roll 5. However, the same water spray means may create problems if used to separate the web away from a synthetic wire, particularly in high-speed machines. This problem is remedied by means of the present invention.

Following the head roll 5 an air spray is provided or a combined air-water spray 11. The spray 11 is positioned quite close to the wire, e.g. at a distance of 5 to 100 millimeters from it and consists of a number of nozzles 12 positioned in a row and spaced equal distances apart, e.g. 150 to 300 millimeters. The spray is supplied with a high pressure, e.g. in the region of 2 to 20 above atmospheric pressure. In the present case the spray is illustrated in a position at the inner face of the fabric 2 but may also be positioned at the outer face thereof. Spray 11' is shown at the outer face. This spray is used to cut the web a into lengthwise strips. This breaks up the air flowing conditions prevailing around the fabric 2 and the web falls away from the fabric through gravity.

A further air spray 13 is positioned after spray 11. This second air spray 13 is provided with a slot or a row of slots 14 extending across the entire machine. The slot width may be e.g. 0.5 to 3 millimeters for each slot and the pressures between 0.1 and 0.6 above the atmospheric pressure. This is considerably below the values presently used in the industry in other methods of web separation such as separation of a web which is continuous over its entire width. This air spray means preferably contacts the fabric or is positioned very close to it, e.g. at a distance of 0 to 2 millimeters.

To "lubricate" the surface of contact of the fabric 2 a water spray 15 may be inserted after the air spray 11. The air jet from the spray 13 may also be admixed with a small amount of water droplets. The three spray 11, 13, and 15 may with advantage be combined into one single unit.

The present method has proved to be a most efficient way of separating the fibre web a from the fabric 2. At high machine speeds, e.g. above 300 meters/minute, the efficiency is considerably higher than in existing conventional spray systems.

In accordance with the embodiment illustrated the spray 11, 13, 15 are positioned after the head roll 5 and this positioning is the most suitable one for the type of machines indicated. Naturally, the spray system may be positioned in a different way but positions, e.g. ahead of the head roll 5, bring about the risk that fibres spurt onto the pick-up felt 7, polluting the latter.

Figure 3A:
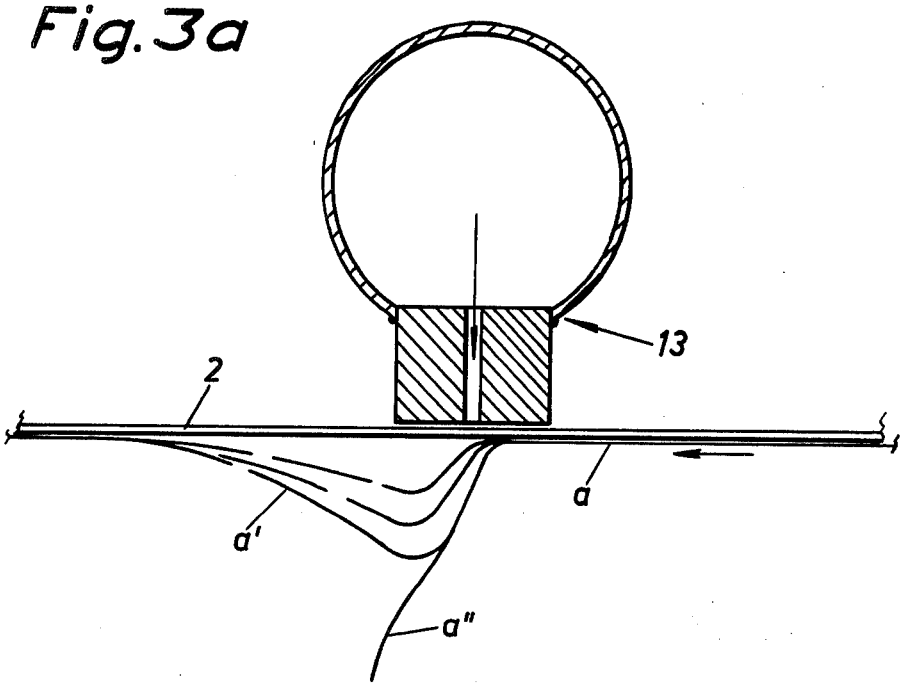
FIG. 3*a* and 3*b* illustrate schematically the effects obtained in accordance with the present invention.
Figure 3B:
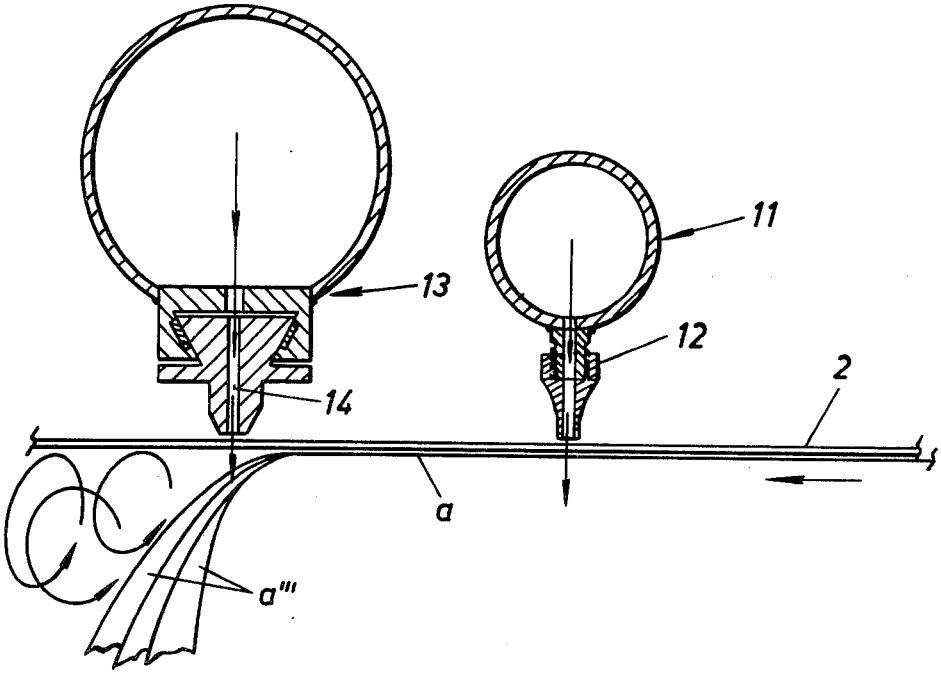
Figure 4:
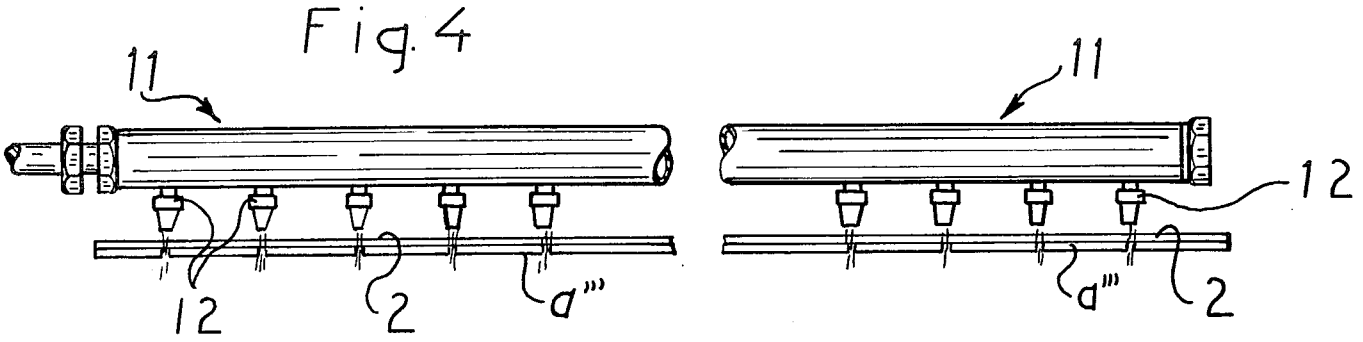
FIG. 4 is a broken side view of one of the spray means utilized in the practice of this invention.
Figure 5:
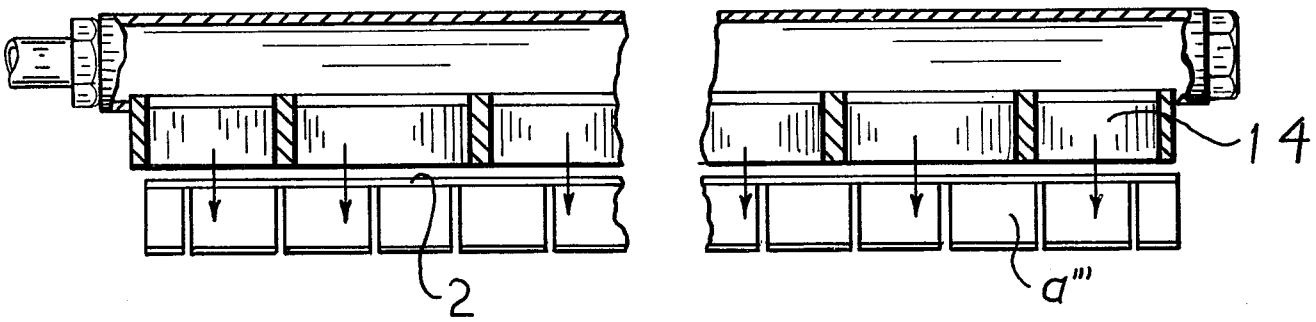
FIG. 5 is a broken axial longitudinal sectional view through a second spray means utilized in this invention.

The principle of the invention appears from FIG. 3*b* in comparison with FIG. 3*a*. Without division of the web a into strips, as in FIG. 3*a*, the web having somewhat separated from the wire, is again sucked into a position against the fabric 2 when exposed to a certain minimum pressure thus again accompanying the wire. Further pressure increase of the air spray 12, although resulting in separation of the web a, only means that the web will accompany the boundary layer of air flow along the wire, following the flow curve a′ (FIG. 3*a*). Additionally higher pressures are required to remove and separate the web completely from the wire in accordance with the flow curve a″ (FIG. 3*a*).

Division of the web a into strips in accordance with this inventive method as shown in FIG. 3*b* breaks up the flow conditions prevailing in the boundary layer close to the fabric 2, on account of air passage and flapping of the strips a‴ into which the paper web is divided, and the web separates from the wire upon the application of minimal air pressure.

The expression nozzles 12 as used herein is to be considered to embrace apertures formed in pipe walls, socket means on pipes and similar arrangements.

The spray 13 incorporating slots 14 may be in the form of an air spray means having a water attachment, i.e. an emulsion of air and water is sprayed through the slots, whereby separation of the paper web strips from the wire is further facilitated.

We claim:

1. An improved method for knocking down and separating a web from the forming fabric in a paper making machine comprising forcing a first pressurized medium against and through said fabric in a plurality of spaced sprays extending transversely of said fabric to divide said web into lengthwise strips and thereafter forcing a second pressurized medium through said fabric to remove the strips.

2. An improved method in accordance with claim 1 in which air under pressure is utilized as the first pressurized medium.

3. An improved method in accordance with claim 1 in which air under pressure is utilized as the second pressurized medium.

4. An improved method in accordance with claim 1 in which water under pressure is utilized as the first pressurized medium.

5. An improved method in accordance with claim 1 wherein the second pressurized medium utilizes air under pressure and water under pressure is additionally supplied as part of the second pressurized medium.

6. An improved method in accordance with claim 1 in which water is provided for lubricating the forming fabric.

7. An improved method in accordance with claim 1 in which said plurality of spaced sprays are equidistant from each other.

8. An improved method of knocking down and separating a paper web from the forming wire in a paper machine, the improvement comprising dividing said paper web into lengthwise strips with the aid of a first spraying means including a plurality of nozzles in communication with a source of pressurized medium and spaced apart in the transverse direction of the forming wire, and thereafter knocking down and separating from said forming wire the paper web strips thus formed by the jets of pressured medium issued from said nozzles, with the aid of a second spraying means in communication with a source of pressurized medium and arranged following said first spraying means as seen in the direction of travel of said web, said second spraying means issuing a curtain of pressurized medium across the entire wire width of said wire to remove said web strips from said wire.

9. An improved method for knocking down and separating a web from the forming wire in a paper making machine by means of a first and a second spraying device positioned in succession in the running direction of said wire and each extending transversely thereof and situated at the side of said wire which is opposite said web, the improvement comprising forcing a pressurized medium through said first spraying device against and through said wire thereby dividing said web into lengthwise strips and forcing a pressurized medium through said second spraying device against and through said wire thereby removing said web strips from said wire.

* * * * *